US006488219B1

(12) United States Patent
Herr

(10) Patent No.: US 6,488,219 B1
(45) Date of Patent: Dec. 3, 2002

(54) STEAM HUMIDIFIER WITH PRESSURE VARIABLE APERTURE

(76) Inventor: D. Scott Herr, 1834 Freedom Rd., Lancaster, PA (US) 17601

( * ) Notice: Subject to any disclaimer, the term of this patent is extended or adjusted under 35 U.S.C. 154(b) by 0 days.

(21) Appl. No.: 09/358,696

(22) Filed: Jul. 21, 1999

(51) Int. Cl.[7] ..... B05B 1/30; B05B 15/00; B05B 1/00; A62C 31/00

(52) U.S. Cl. ..... 239/533.13; 239/547; 239/602; 239/DIG. 12; 239/436

(58) Field of Search ..... 239/547, 568, 239/533.13, 418, 434, 398, 412, 546, 602, DIG. 12, 436, 437, 77, 451, 107; 261/43, 96, 83, 92, DIG. 46; 138/124, 157

(56) References Cited

U.S. PATENT DOCUMENTS

| | | | | | |
|---|---|---|---|---|---|
| 2,949,239 | A | | 8/1960 | Goyette | 239/120 |
| 3,002,700 | A | | 10/1961 | Mohring | 234/455 |
| 3,096,817 | A | | 7/1963 | McKenna | 165/60 |
| 3,186,644 | A | * | 6/1965 | Ross et al. | 239/534 |
| 3,333,422 | A | * | 8/1967 | Neyland | 239/547 |
| 3,467,313 | A | | 9/1969 | Repmeier | 239/134 |
| 3,640,456 | A | * | 2/1972 | Strugis | 237/7 |
| 3,736,755 | A | * | 6/1973 | Hammond et al. | 239/533.13 |
| 3,899,135 | A | | 8/1975 | O'Brien | 239/534 |
| 3,923,483 | A | | 12/1975 | Himer et al. | 55/463 |
| 4,061,162 | A | * | 12/1977 | Jones et al. | 138/147 |
| 4,167,953 | A | * | 9/1979 | Carlstrom | 138/133 |
| 4,193,552 | A | * | 3/1980 | Ishikawa | 239/533.13 |
| 4,270,702 | A | | 6/1981 | Nicholson | 239/455 |
| 4,384,873 | A | | 5/1983 | Herr | 55/263 |
| 4,395,885 | A | * | 8/1983 | Cozby | 60/669 |
| 4,408,116 | A | * | 10/1983 | Turner | 219/273 |
| 4,572,428 | A | | 2/1986 | Groff et al. | 236/44 A |
| 4,671,456 | A | | 6/1987 | Groff et al. | 236/44 A |
| 4,835,851 | A | * | 6/1989 | Peele et al. | 29/272 |
| 5,054,105 | A | * | 10/1991 | Kiyimaa et al. | 392/394 |
| 5,277,849 | A | | 1/1994 | Morton et al. | 261/118 |
| 5,372,753 | A | | 12/1994 | Morton | 261/118 |
| 5,376,312 | A | | 12/1994 | Morton et al. | 261/118 |
| 5,516,466 | A | | 5/1996 | Schlesh et al. | 261/117 |
| 5,543,090 | A | | 8/1996 | Morton et al. | 261/118 |
| 5,649,860 | A | * | 7/1997 | Giuffrida | 239/533.13 |

FOREIGN PATENT DOCUMENTS

| | | | | |
|---|---|---|---|---|
| DE | 1167280 | * | 4/1964 | 239/310 |
| DE | 25 08 865 | * | 9/1976 | 239/533.13 |

* cited by examiner

*Primary Examiner*—Michael Mar
*Assistant Examiner*—David Hwu
(74) *Attorney, Agent, or Firm*—Shlesinger, Arkwright & Garvey LLP

(57) ABSTRACT

A humidifier for providing moisture to an airstream within an airduct comprises a base manifold configured for being secured to a side of the airduct, the base manifold including a steam inlet valve and a condensate drain valve; and a distributor pipe secured to the base manifold and configured to extend into the airduct, the distributor pipe being in communication with the base manifold. The distributor pipe includes first and second slots disposed opposite each other and longitudinally along a major portion of the length of the pipe, and the pipe is subject to flexing such that the slots open up in response to the steam being introduced thereinto, thereby to release steam in the airstream.

25 Claims, 5 Drawing Sheets

STEAM HUMIDIFIER WITH PRESSURE VARIABLE APERTURE

FIELD OF THE INVENTION

The present invention relates generally to a steam humidifier used in HVAC systems in buildings.

BACKGROUND OF THE INVENTION

Since 1985, most steam humidifiers used steam injection manifolds that contain nozzles in the duct distributor pipes. The nozzles can be in the form of plain holes placed along the length of the pipe. This arrangement has been found to be unsatisfactory, since it allows the condensate to flow out of the holes into the airstream along with the steam. By using nozzles instead of plain holes that feed off the center of the pipe where the steam is hottest and driest, condensate is prevented from getting out with the steam.

However, it is labor intensive to install the nozzles into the steam distributor pipes, since holes must be drilled before the nozzles can be inserted, into them and if a mistake is made on capacity, it is very difficult, if not impossible, to add nozzles to increase capacity Exceeding the capacity of the nozzles results in a very heavy steam flow, which takes longer to evaporate in the airstream. In some cases, the nozzles used have been made of plastic and can come loose and leak or blow out of the distributor pipes.

To shorten the distance it takes for the steam to evaporate in the airduct, the number of distributor pipes have been increased to spread out the steam output over the entire cross-sectional area of the airduct. However, because there is now more surface of the distributor pipes exposed to the cold airstream, the result is usually more condensate production (which can be as much as 50% loss of the steam to condensate), loss of steam output, and heat-gain to the air in the airduct, which could be as much as 15° F. If the building is under cooling load, this heat-gain to the airstream will be detrimental to maintaining the building temperature.

In view of the above, there is, therefore, a need for a steam humidifier that avoids the shortcomings of the prior art.

OBJECTS AND SUMMARY OF THE INVENTION

It is an object of the present invention to provide a steam humidifier where the steam distributor pipes are provided with pressure variable apertures, instead of standard nozzles, that adjust their output to meet the demand.

It is another object of the present invention to provide a steam humidifies where the steam distributor pipes are installed to the manifold with slip fittings without tools, allowing the pipes to be easily disassembled and cut to fit the height of the airduct.

It is still another object of the present invention to provide a steam humidifier where the distributor pipes can be cut in the field to fit the height of the existing airduct without any detrimental effect to its steam distribution capacity.

It is another object of the present invention to provide a steam humidifier that can easily be retrofitted to switch to a different means of steam production, including direct steam, steam heat exchanger, electric coil, or gas-fired heat exchanger.

It is still another object of the present invention to provide a steam humidifier where the steam distributor pipes are insulated and where the nozzles are fed from the central part of the pipes where steam is hottest and driest, thereby minimizing production of condensate.

It is another object of the present invention to provide a steam humidifier where the contact ratio of steam to air is substantially 100%.

In summary, the present invention provides a humidifier for providing moisture to an airstream within an airduct, comprising a base manifold configured for being secured to a side of the airduct, the base manifold including a steam inlet valve and a condensate drain valve; and a distributor pipe secured to the base manifold and configured to extend into the airduct, the distributor pipe being in communication with the base manifold.

The present invention also provides a humidifier for providing moisture to an airstream within an airduct, comprising a base manifold configured for being secured to a side of the airduct; a heat-exchanger disposed within the base manifold configured to boil water disposed within the base manifold to steam; and a distributor pipe secured to the base manifold and configured to extend into the airduct, the distributor pipe being in communication with the base manifold.

The present invention further provides a nozzle for dispensing moisture into an airstream, comprising a pipe having a first end for connecting to a source of steam and a closed second end; first and second slots disposed opposite each other and longitudinally along a major portion of the length of the pipe; and the pipe being subject to flexing such that the slots open up in response to the steam being introduced thereinto, thereby to release steam in the airstream.

The present invention also provides a method for humidifying an airstream in a duct, comprising providing a nozzle configured to provide a sheet pattern of spray; disposing the nozzle in the airstream; connecting the nozzle to a source of steam; directing the steam sheet pattern transversely to the direction of the airstream such that maximum surface area of the sheet pattern is presented to the airstream.

These and other objects of the present invention will become apparent from the following detailed description.

BRIEF DESCRIPTIONS OF THE DRAWINGS

DETAILED DESCRIPTION OF THE INVENTION

Figure 1:
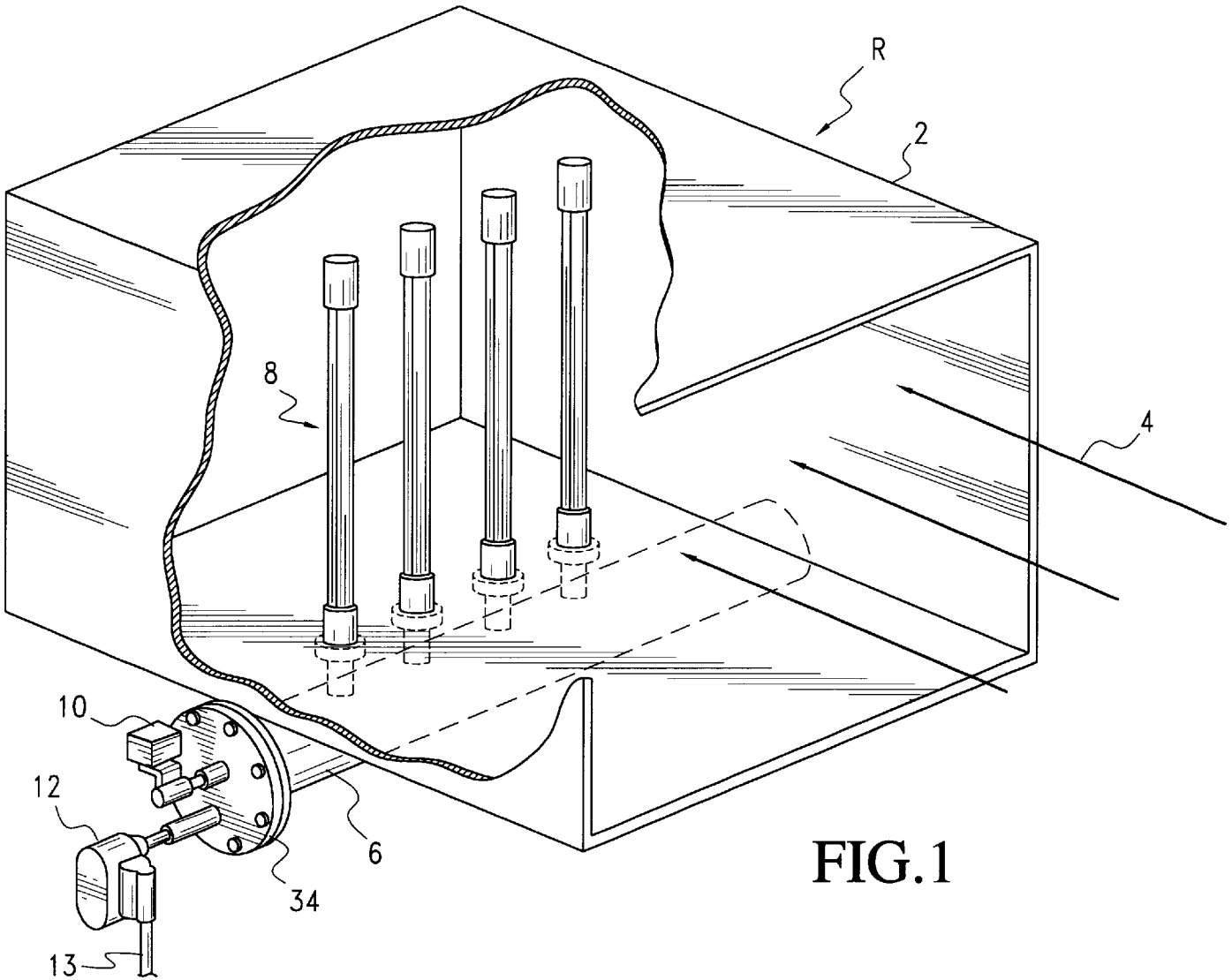
FIG. 1 is a schematic perspective view of a steam humidifier installed in an airduct with portions shown in cross-section and broken out.

A steam humidifier R made in accordance with the present invention is disclosed in FIG. 1. The humidifier R is operably associated with an airduct 2 in which an airstream 4 is maintained for the HVAC requirements of the building. Moisture is added to the airstream by means of the humidifier R to maintain the building air at some humidity levels.

Figure 2:
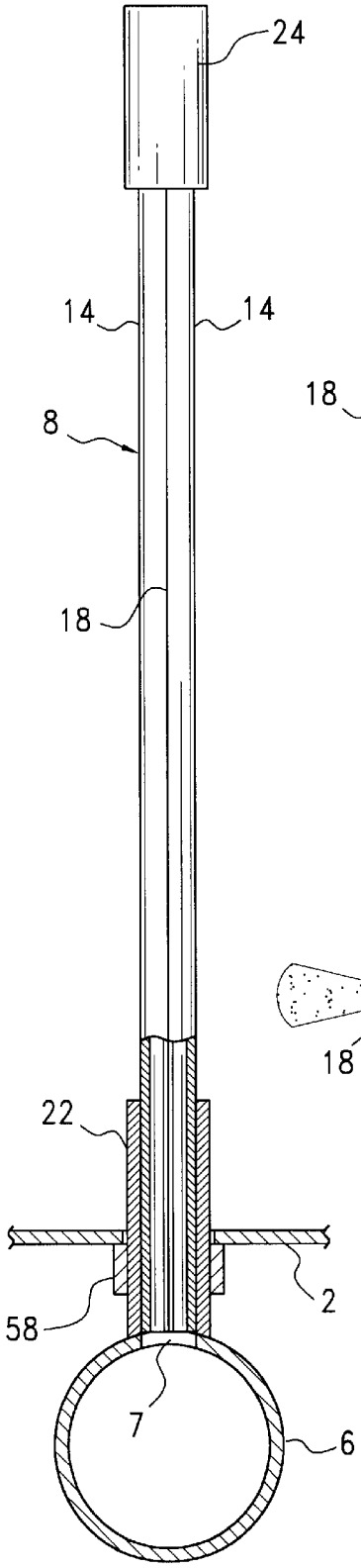
FIG. 2 is a side elevational view, with a portions in cross-section of the steam humidifier of the present invention, under low or no-load conditions.

The steam humidifier R comprises a base manifold 6, preferably disposed outside the airduct 2. A plurality of steam distributor pipes 8 are disposed within the airduct 2 and are operably connected to the base manifold 6. Each distributor pipe communicates with the base manifold through a respective opening 7, as best shown in FIG. 2. Each steam distributor pipe 8 functions as a nozzle, dispensing steam into the airstream 4.

Steam is supplied to the base manifold 6 through a valve 10 which may be controlled by a humidity sensor (not shown) or other standard controller. Condensate collects in the base manifold 6 and is drained out through a standard steam trap 12, which allows condensate to drain out to drain tube 13 but not the steam. The base manifold 6 separates the incoming steam from the condensate flowing down from the distributor pipe 8.

Figure 3:
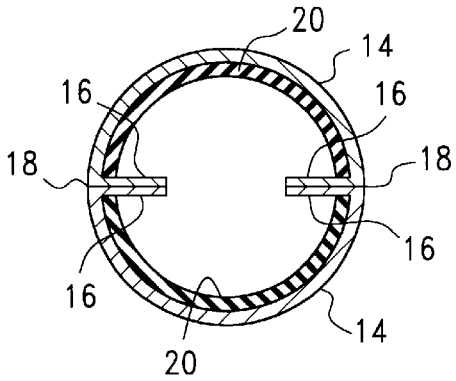
FIG. 3 is a cross-sectional view taken along line 3—3 of FIG. 6.

Each distributor pipe 8 is made from two half-pipe sections 14, as best shown in FIGS. 2 and 3. Each section 14 has inwardly directed flange portions 16 that define a slot 18 with the opposing flange portion 16 in the other half-pipe section 14. The flange portions 16 advantageously extend the slots 18 into the central portion of the distributor pipe 8 where the steam is driest to prevent condensate release into the airduct 2, which can cause wetting on the bottom of the airduct.

An insulating jacket 20 is disposed on the inside arcuate surface of each half-pipe section 14 to advantageously reduce condensate production, generally indicated at 21, thereby improving efficiency. The insulating jacket 20 also advantageously reduces the heat gain to the airduct, minimizing interference with the airconditioning system. Further, since the insulating jacket 20 is internal, no rubber or plastic parts are exposed to the airstream.

The insulating jacket 20 can be either a liquid applied during assembly or a loose sleeve of material slip into each half-pipe section. Silicon rubber is preferable since it holds up to the steam and provides a slick surface for the condensate to run down back to the base manifold 6 where it is collected.

The two half-pipe sections 14 are held together by a slip fitting connector 22. The connector 22 is made from a pipe and secured by standard means to the base manifold 6. An end cap 24 is used to secure the other end of the two half-pipe sections 14, as best shown in FIG. 2. The two half-pipe sections 14 are advantageously fit together with the connector 22 and the end cap 24 without tools, so that the half-pipes can be easily disassembled and be cut to size if needed in the field on a factory floor to permit customization of the size to fit the airduct.

Figure 5:
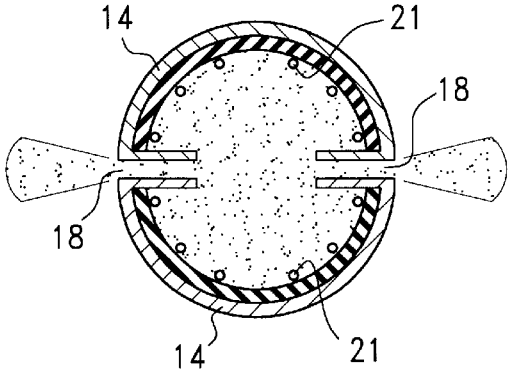
FIG. 5 is a cross-sectional taken along line 5—5 of FIG. 7.
Figure 6:
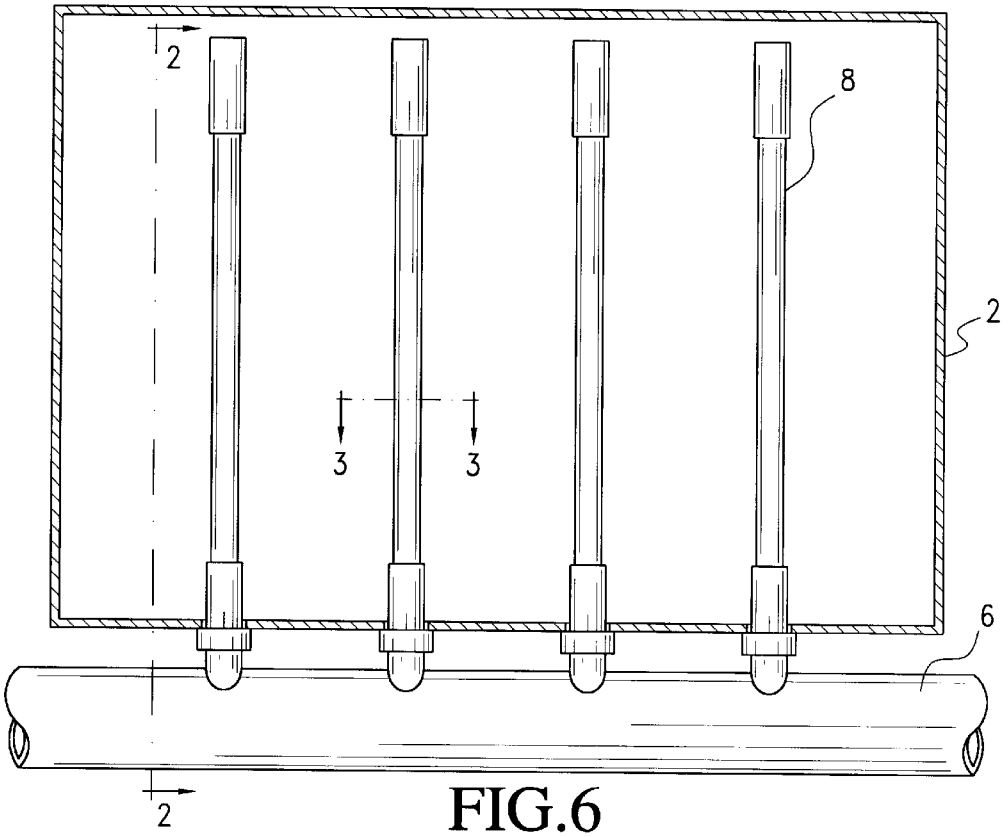
FIG. 6 is a view across the cross-section of the airduct, showing the steam humidifier in a low load or off conditions state.
Figure 7:
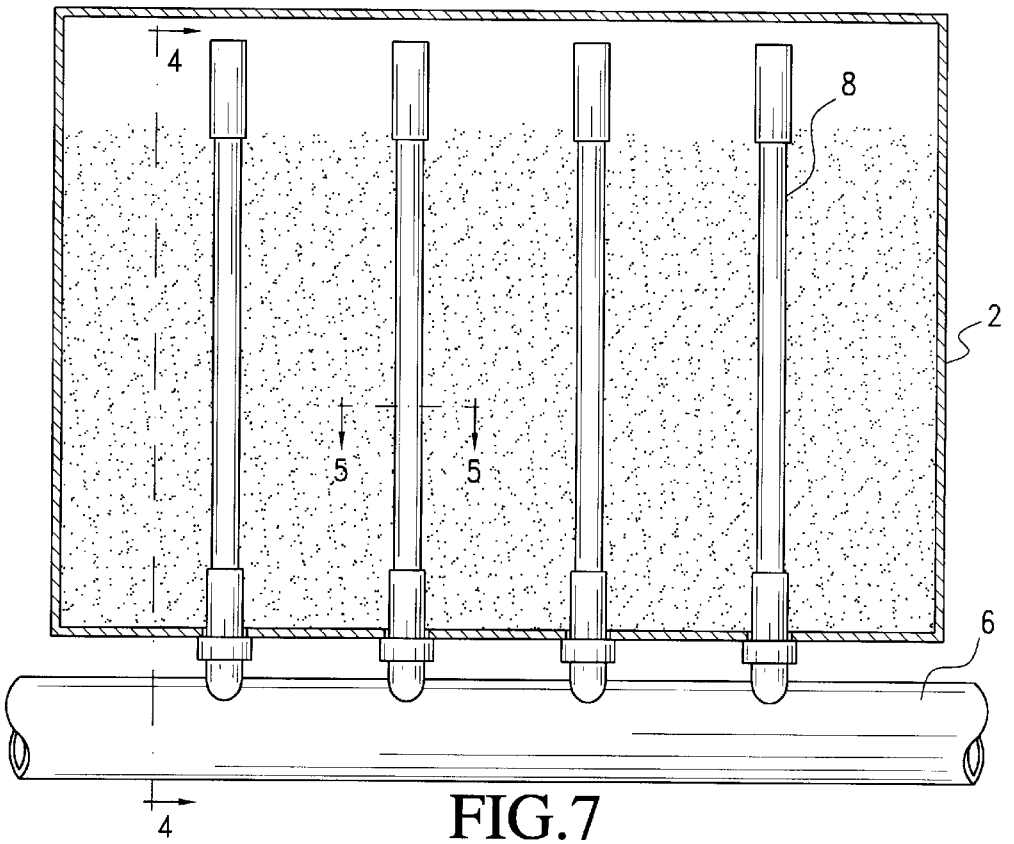
FIG. 7 is a view across the cross-section of the airduct, showing the humidifier generating a sheet pattern of steam substantially perpendicular to the airflow.

Steam is discharged through the slot 18, creating a sheet of steam substantially 90° to the airstream, as best shown in FIGS. 5 and 7. The airstream then turns the sheet and carries it downstream and is absorbed. The contact ratio of steam to air is about 100%, advantageously providing maximum absorption by the airstream.

Figure 4:
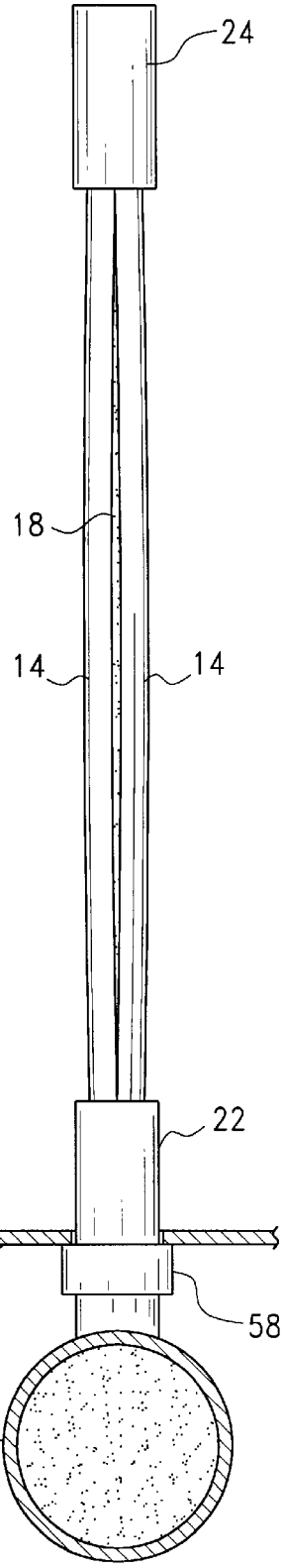
FIG. 4 is a side elevational view, with portions shown in cross-section of the steam humidifier under load conditions.

Each distributor pipe 8 is preferably made from a light gauge stainless steel configured to flex as steam pressure is applied inside the pipe, causing the slots to open or close with the steam flow, thereby providing a variable aperture that will ensure equal distribution over the entire length of the base manifold 6 and therefore the best steam distribution to the airstream within the airduct 2, as best shown in FIGS. 4, 5 and 7.

Under low flow conditions, the slots 18 are mostly closed, ensuring equal steam output over the entire length of the distributor pipe 8. Under high flow condition, the distributor pipe 8 will flex open from the middle, advantageously putting most of the steam in the center of the airstream where it can be most readily absorbed.

Steam enters the distributor pipe 8 from the base manifold 6 and flows upwardly through the openings 7, passing over condensate 21 returning downwardly to the base manifolds 6, as best shown in FIG. 5. The cross-flow operation results in much of the condensate 21 flashing the back into usable steam, as the condensate contacts the rising hot steam.

Figure 8:
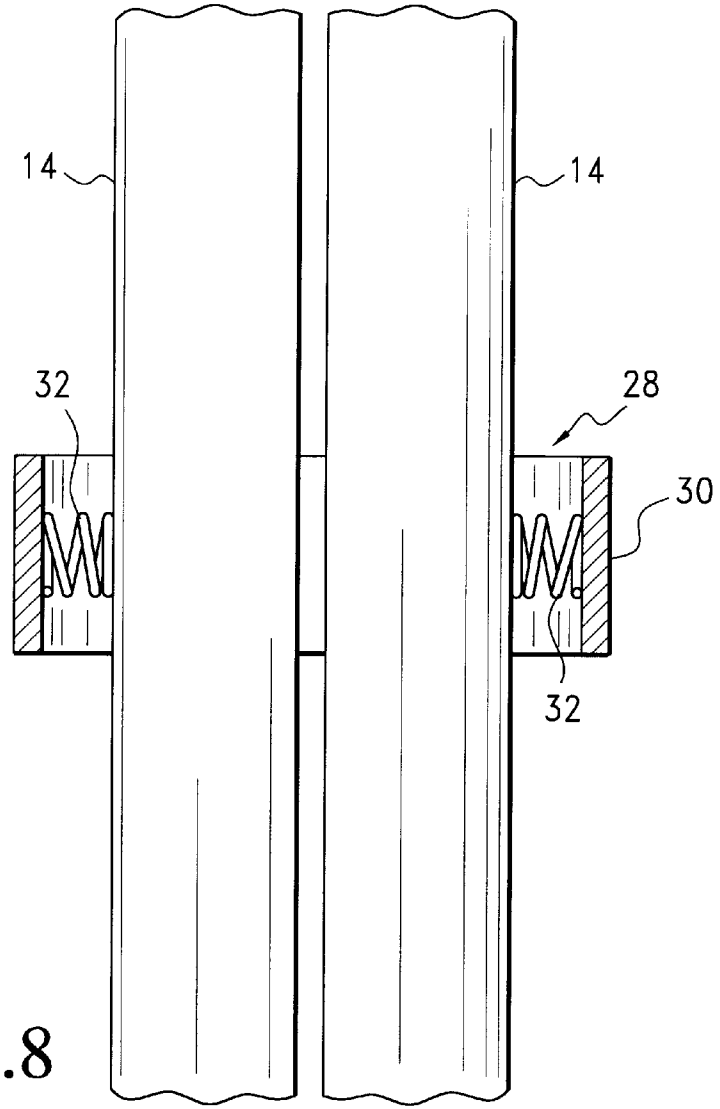
FIG. 8 is an enlarged view of a portion of the distributor pipe showing a clamp assembly using the present invention.
Figure 9:
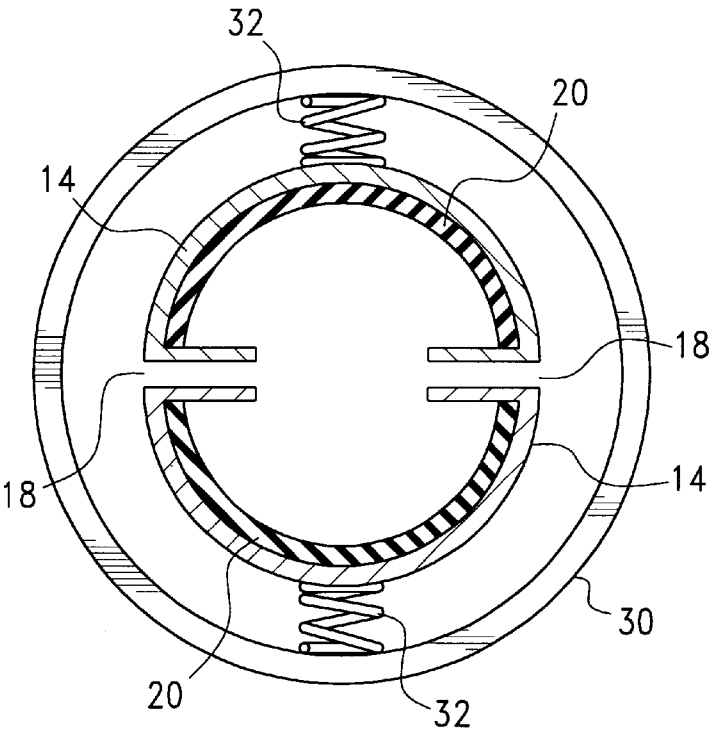
FIG. 9 is a cross-sectional view taken along line 8—8 of FIG. 8.

A spring loaded clamp assembly 28 can be used to advantageously control the flexing of the half-pipe sections 14 during high flow conditions, as best shown in FIGS. 8 and 9. The clamp assembly 28 includes a band 30 with a pair of diametrically opposed springs 32 that are so disposed as to urge the two half-pipe sections 14 towards each other, thereby to control the opening of the slots 18. The springs 32 and the diameter of the band 30 can be sized to provide more or less flex to the half-pipe sections 14.

The clamp assembly 28. is preferably disposed at the middle of the distributor pipe 8 where maximum flex occurs and, therefore, where maximum control is required.

Figure 10:
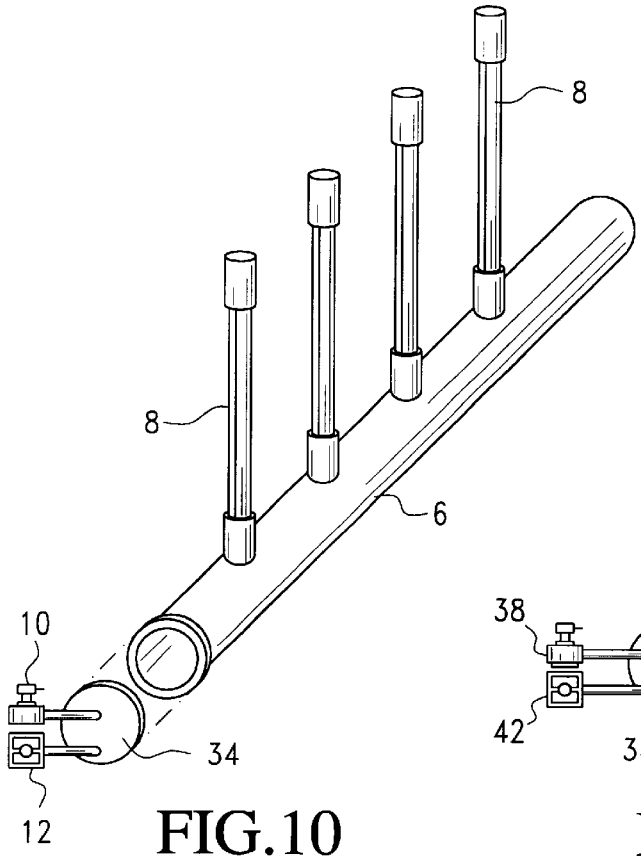
FIG. 10 is a schematic perspective view of the humidifier of the present invention, showing a feed cap removed from the base manifold.

The base manifold 6 can be made from standard stainless steel pipe with a flanged end bell at one end and a feed bell 34 at the other end, as best shown in FIG. 1. The feed bell 34 can easily be removed if retrofitting is required to change the humidifier to a different steam source. A direct steam embodiment is shown in FIGS. 1, 4 and 10, where steam, generated remotely in a boiler, is directly fed into the base manifold 6 and to the several distributor pipes 8.

Figure 11A:
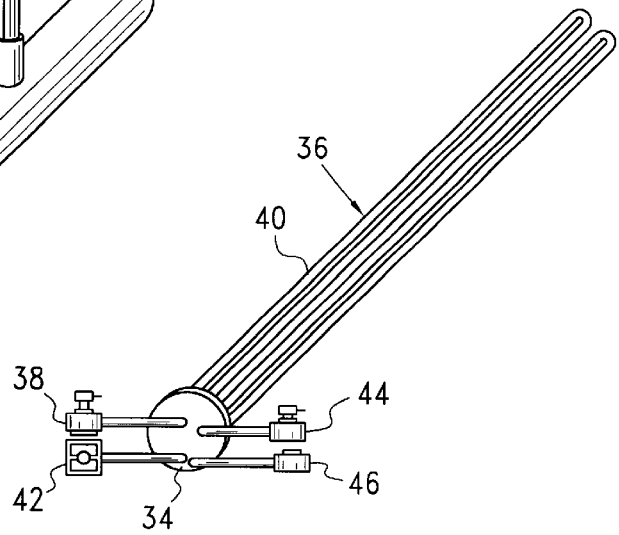
FIG. 11A is a schematic perspective view of a steam heat-exchanger for placement within the base manifold for generation of steam.

A steam-to-steam heat exchanger 36 is disclosed in FIG. 11A. A steam valve 38 is operably connected to a steam source and feeds it to a heat exchanger coil 40, which is adapted to be disposed within the base manifold 6. The other end of the heat exchanger coil 40 is connected to steam trap 42 that permits condensate to drain out but keeps the steam in. A water inlet valve 44 fills the base manifold 6 to an operating level and is controlled by a float or other standard means. A water drain valve 46 permits periodic draining of the base manifold 6 to advantageously reduce mineral build-up. Heat from the coil 40 boils the water to create steam.

Figure 11B:
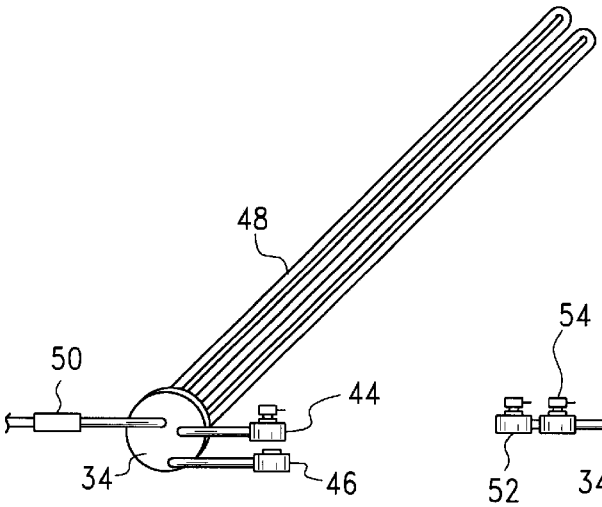
FIG. 11B is a schematic perspective view of an electric coil for placement within the base manifold for generation of steam.

In another embodiment, steam generation is provided by a set of electric coils 48 configured to fit within the base manifold 6, as best shown in FIG. 11B. A switch 50, controlled by standard means such as a humidity sensor, turns the electric col 48 on and off to generate steam as needed.

Figure 11C:
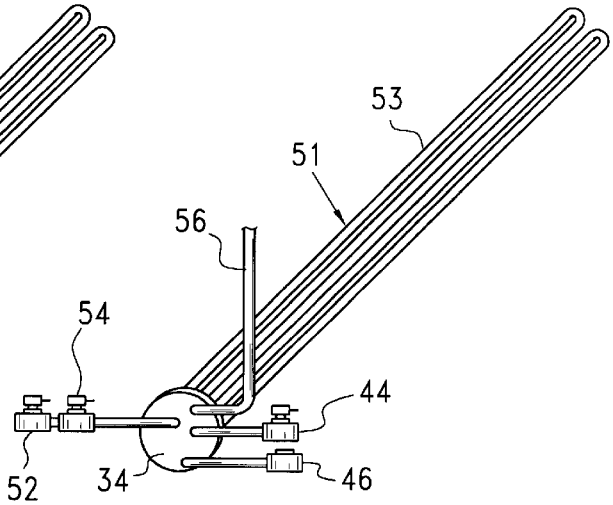
FIG. 11C is a schematic perspective view of a gas-fired heat-exchanger for placement within the base manifold for generation of steam.

Steam generation may also be provided by a gas-fired heat exchanger 51, as best shown in FIG. 11C. Hot flue gas from gas combustion is forced into a heat exchanger coil 53 to boil the water inside the base manifold 6. A gas valve 52, controlled by standard means, is operably connected to a burner 54 which fires into the coil 53, which functions as a flue pipe. An exhaust pipe 56 is operably connected to the coil 53 to vent the products of combustion.

The various means for providing steam for humidification makes the humidifier R advantageously flexible so that the user can easily retrofit the humidifier to a different source of steam to meet his changing needs. For example, the user may start with a direct steam embodiment, where steam is generated remotely from the apparatus. If the boiler treatment chemicals later become a problem, the user can change to a steam or electric heat exchanger or to a gas fired heat exchanger by simply removing the feed bell 34 and inserting within the base manifold 6 one of the heat exchangers disclosed herein.

Mounting collars 58 are used to secure the system R to the airduct 2, as best shown in FIG. 2. Each mounting collar 58 may be made from a steel plate which is then secured by conventional means to the connector 22. Standard fasteners are used to secure the collars 58 to the underside of the airduct 2.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A nozzle for dispensing moisture into an airstream, comprising:

a) a pipe having a first end for connecting to a source of steam and a closed second end;

b) first and second slots disposed opposite each other and longitudinally along a major portion of the length of said pipe; and c) said pipe being subject to flexing such that said slots open up in response to the steam being introduced thereinto, thereby to release steam in the airstream.

2. A nozzle as in claim 1, wherein:

a) said pipe is made from first and second longitudinal halves and joined at said first and second ends.

3. A nozzle as in claim 2, wherein:

a) one end of said pipe includes a slip fitting cap configured to join said two halves together; and b) the other end of said pipe is configured to be secured to a base manifold.

4. A nozzle as in claim 2, wherein:

a) each half includes longitudinal flanges disposed opposite respective flanges.

5. A nozzle as in claim 4, wherein:

a) said flanges include longitudinal edges disposed near the center of said pipe.

6. A nozzle as in claim 1, wherein:

a) said pipe is insulated on its inside surface.

7. A nozzle as in claim 1, wherein:

a) said first and second slots are biased toward the closed position.

8. A nozzle as in claim 1, and further comprising:

a) spring configured to oppose the transversal flexing of said pipe.

9. A nozzle as in claim 8, and further comprising:

a) a band disposed around a middle portion of said pipe;

b) a first spring disposed between said band and said pipe such that transversal expansion of said pipe causes said spring to compress.

10. A nozzle as in claim 9, and further comprising:

a) a second spring disposed opposite said first spring.

11. A nozzle as in claim 1, and further comprising:

a) a manifold connected to said first end.

12. A nozzle as in claim 11, wherein:

a) said manifold is longitudinal; and b) said pipe is disposed substantially vertically with respect to said manifold.

13. A nozzle as in claim 11, wherein:

a) said manifold is configured to be secured to an airduct.

14. A nozzle as in claim 11, further comprising:

a) a source of steam to supply steam to said manifold.

15. A nozzle as in claim 14, wherein:

a) said manifold includes a steam inlet valve and a condensate drain valve.

16. A nozzle as in claim 14, wherein:

a) said source of steam is generated within said manifold.

17. A nozzle as in claim 14, wherein:

a) said source of steam is generated with a steam heat-exchanger disposed within said manifold.

18. A nozzle as in claim 14, wherein:

a) said source of steam is generated with an electric coil disposed within said manifold.

19. A nozzle as in claim 14, wherein:

a) said source of steam is generated with a gas-fired heat-exchanger disposed within said manifold.

20. A nozzle as in claim 11, wherein:

a) said manifold includes mounting supports for securing to an airduct.

21. A nozzle as in claim 11, wherein:

a) said manifold includes a slip fitting connector; and b) said first end of said pipe is disposed within said connector.

22. A nozzle as in claim 11, and further comprising:

a) a heat-exchanger disposed within said manifold configured to boil water disposed within said manifold to steam.

23. A nozzle as in claim 22, wherein:

a) said heat-exchanger is a steam heat-exchanger.

24. A nozzle as in claim 22, wherein:

a) said heat-exchanger is an electric coil.

25. A nozzle as in claim 22, wherein:

a) said heat-exchanger is a gas-fired heat-exchanger.

* * * * *